US006363765B1

(12) United States Patent
Seok et al.

(10) Patent No.: US 6,363,765 B1
(45) Date of Patent: Apr. 2, 2002

(54) SHEAR DEFORMATION DEVICE FOR SCALPING

(75) Inventors: Hyun-Kwang Seok; Jae-Chul Lee; Jong-Woo Park; Young-Hoon Chung; Ho-In Lee, all of Seoul (KR)

(73) Assignee: Korea Institute of Science and Technology, Seoul (KR)

( * ) Notice: Subject to any disclaimer, the term of this patent is extended or adjusted under 35 U.S.C. 154(b) by 0 days.

(21) Appl. No.: 09/638,763

(22) Filed: Aug. 15, 2000

(30) Foreign Application Priority Data

May 6, 2000 (KR) ..... 00-24220

(51) Int. Cl.[7] ..... B21C 23/00
(52) U.S. Cl. ..... 72/253.1; 72/255
(58) Field of Search ..... 72/253.1, 254, 72/255, 262, 257, 270

(56) References Cited

U.S. PATENT DOCUMENTS

| | | | | | |
|---|---|---|---|---|---|
| 4,468,945 | A | * | 9/1984 | Fairey | 72/262 |
| 4,484,876 | A | * | 11/1984 | Childs et al. | 72/262 |
| 4,794,777 | A | * | 1/1989 | East et al. | 72/262 |
| 5,167,138 | A | * | 12/1992 | Sinha et al. | 72/262 |

FOREIGN PATENT DOCUMENTS

| | | | | |
|---|---|---|---|---|
| JP | 58-32514 | * | 2/1983 | 72/262 |
| JP | 61-82922 | * | 4/1986 | 72/262 |
| JP | 1-15218 | * | 1/1989 | 72/262 |
| JP | 1-241321 | * | 9/1989 | 72/262 |
| JP | 6-126325 | * | 5/1994 | 72/262 |

OTHER PUBLICATIONS

Plastic Working of Metals by Simple Shear (pp. 99–105, Russian Metallurgy, 1981.
Direct Observation of Shear Deformation during Equal Channel Angular Pressing of Pure Aluminum, (pp. 353–357, Scripta Materialia, No. 4, Vo. 41, 1999).
An Experimental Study of Equal Channel Angular Extrusion (pp. 437–442, Scripta Materialia, No. 4, vol. 37, 1997).

* cited by examiner

*Primary Examiner*—Ed Tolan
(74) *Attorney, Agent, or Firm*—Scully, Scott, Murphy & Presser

(57) ABSTRACT

The present invention relates to a shear deformation device. To improve the productivity by solving the problem that the amount of shear deformation of a material is not uniform and sufficient due to the gap between the curved portion of the molding path and the lower parts of the material and omitting any additional process for removing irregularity and surface products on the surface of the material, there is provided a shear deformation device capable of scalping, characterized in that a scalping guide path which allows the surface of the material to be separated from the other portions of the material as the material is scalped at a predetermined thickness when passing through the curved portion during shear deformation is formed in the curved portion in communication with the molding path. In addition, there are provided additional constructions for effectively performing shear deformation by a small power by reducing the friction at the molding path excepting the curved portion. The present invention thusly constructed can be utilized for continuously and effectively mass-produce sheared materials.

18 Claims, 9 Drawing Sheets

SHEAR DEFORMATION DEVICE FOR SCALPING

BACKGROUND OF THE INVENTION

1. Field of the Invention

The present invention relates to a shear deformation device for shearing materials, generally, metal materials, and more particularly, to a shear deformation device capable of shearing and at the same time scalping the materials at a predetermined thickness.

2. Description of the Background Art

The shear deformation process is a process of obtaining a sheared material by passing a material into a mold for shear deformation having a molding path at which a curved portion is formed, and allowing shear deformation of the material to occur at the curved portion. This process has the object of fabricating a material of high strength and high plasticity by improving the strength of the material and forming a texture having a certain direction.

The above-mentioned shear deformation processes includes equal channel angular pressing (ECAP), equal channel angular drawing (ECAD), continuous ECAP process, and so on. FIGS. 1*a*, 1*b* and 2 are views schematically illustrating shear deformation devices performing these shear deformation processes, respectively. As illustrated therein, the shear deformation devices are identical with one another in that each shear deformation device is constructed of molds 1, 2, 6, and 7 provided with molding paths 3 and 8 having a curved portion shown in dotted line, but they are different from one another with respect to a means for applying power in order to passing materials 5 and 9 through the molds 3 and 8.

Among these shear deformation processes, in case of equal channel angular pressing, only a sheared material of a limited length is obtained. Once the material is scalped, the next material can be provided only after extracting a punch 4 from the molds 1 and 2, so it is impossible to continuously mass-producing sheared materials. In case of equal channel angular drawing, although it is possible to mass-produce sheared materials, it is difficult to practically use this process because it has little effect for shear deformation. For the continuous mass production of materials having an appropriate amount of shear deformation, a continuous shear deformation device illustrated in FIG. 2 which uses rotary guide apparatuses 10 and 11 in place of the punch 4 in order to continuously perform equal channel angular drawing is suitable.

However, in order to achieve shear deformation as the material implanted into the mold passes through the curved portion, much power is needed. Therefore, in case of using the rotary guide apparatuses 10 and 11, it is general that irregularity is formed on the surface in contact with the material of the rotary guide apparatuses 10 and 11 in order to increase the friction between the material and the rotary guide apparatuses 10 and 11. Subsequently, irregularity corresponding the above irregularity is formed on the surface of the material 9 having passed through the molds 6 and 7 for thereby making the surface rough.

In addition, even though the rotary guide apparatus is not used, there may be formed undesirable surface products on the surface of the material by material finishing processes prior to putting the material into the shear deformation device, that is, rolling and casting.

Meanwhile, in the conventional shear deformation device described above, there is a problem that the materials 5 and 9 cannot be tightly attached to the lower molds 2 and 7, and thus the amount of shear deformation in the lower parts of the materials 5 and 9 becomes insufficient. FIG. 3 is a view illustrating the deformation of a material at a curved portion of a mold by simulation. By this, it is known that a board plank is not completely attached to a molding surface at the curved portion directed by an arrow, but is isolated therefrom. Accordingly, it is known that the amount of shear deformation in the lower portions of the material is not sufficient as compared to other portions, which is confirmed by an actual experiment performed by the inventors. That is, the scales indicated in a vertical direction on the sides prior to shear deformation of the material as shown in FIG. 4*a* are indicated as shown in FIG. 4*b* after passing through the continuous shear deformation device, which indicates that the amount of shear deformation in the lower portions of the material is smaller than that in other portions.

In addition, in the conventional discontinuous or continuous shear deformation devices described above, a curved portion is formed at the center of molding path 3 and 8 having the same widths, and thus the movement of the materials 5 and 9 is inhibited by the friction at the molding path excepting the curved portion at which shear deformation is actually occurred. Therefore, a considerable power plus the power required for shear deformation in the curved portion has to be additionally applied to the materials, which is ineffective.

In addition, there is another problem that the life span of the molds is not long because the abrasion occurred adjacent the curved portion which receives the largest friction force from the molds 3 and 8 is rapidly performed as compared to other portions.

SUMMARY OF THE INVENTION

Accordingly, the objects of the present invention disclosed to overcome the problems encountered in the conventional art will be described.

It is an object of the present invention to provide a shear deformation device capable of shearing material and at the same time removing irregularity or surface products formed on the surface of the material.

It is another object of the present invention to provide a continuous shear deformation device capable of obtaining an uniform and sufficient amount of shear deformation throughout the material by assuring contact between a lower part of the material and a curved portion in a molding path at which the material is sheared.

It is another object of the present invention to provide a continuous shear deformation device capable of press-fitting the material by small power as the friction between the portions of the molding path excepting the curved portion and the material is reduced.

It is another object of the present invention to provide a continuous shear deformation device capable of assuring a longer life span of the mold.

It is another object of the present invention to provide a continuous shear deformation device which can be compatibly used in response to materials of different thickness, that is, from thin-walled materials to thick-walled materials.

To achieve the above objects, there is provided a shear deformation device capable of scalping in accordance with the present invention which includes a mold having a molding path at which a curved portion is formed; and a material guiding apparatus for guiding a material to the molding path, wherein a scalping guide path which allows the surface of the material to be separated from the other portions of the material as the material is scalped at a predetermined thickness when passing through the curved portion during shear deformation is formed in the curved portion in communication with the molding path.

The above-mentioned shear deformation device can be a device performing a discontinuous equal channel angular pressing, a device performing a continuous shear deformation, or a device performing an equal channel angular drawing. In case of the discontinuous equal channel angular pressing, a punch corresponds to the guiding apparatus, and in case of the continuous shear deformation device, a rotary guide apparatus is used as the guiding apparatus.

In this case, since the thickness at which the material is scalped is determined according to the inner spacing of the scalping guide path, the scalping guide path can be formed to have a fixed inner spacing. However, in order to scalp the material at a desired thickness, it is preferable that a spacing adjusting apparatus for adjusting the inner spacing of the scalping guide path is additionally included.

As the rotary guide apparatus, a rotary roll contacting materials, or a belt transmission for moving materials by rotating a belt contacting the materials can be used. As the belt, belts of various shapes, such as a roof having a plurality of polyhedron blocks sequentially connected to the same and a belt of which the inside is chain-shaped, can be used. In addition, the rotary guide apparatus can be a combination of the rotary roll and the belt transmission. For example, the rotary guide apparatus can be constructed by installing a plurality of rotary rolls at one side and a belt transmission at the other side. Also, in case of using the belt transmission, it is possible to use a combination of belts of various shapes.

To reinforce the friction between the material and the rotary guide apparatus, it is preferable that irregularity is formed on the surface contacting the material of the rotary guide apparatus, that is, the surface of the rotary roll or the belt. This is achieved by coating the surface using an additional material of high friction coefficient, or by increasing the surface roughness by forming irregularity by mechanical processing. In addition, it is also possible to fabricate a portion directly contacting the material throughout the entire rotary guide apparatus by using a material of high friction coefficient.

The curved portion in the molding path can be formed at the center of the molding path as in the conventional art. Preferably, in order to reinforce the contact between the lower part of the material and the curved portion, the curved portion is constructed by collaboration between the rotary guide apparatus and the opening of the molding path, and the separation between the rotary guide apparatus and the mold constructs the scalping guide path.

And, it is preferable that a lateral guide for guiding and supporting the lateral parts of the material is installed at the rotary guide apparatus in order to prevent the material from being bilaterally moved while passing through the mold for the purpose of shear deformation. Such a lateral guide can be installed at one of the rotary guide apparatus and the mold, or at both of them.

In addition, it is preferable to construct the continuous shear deformation device by installing the rotary guide apparatus and the mold as one part of a continuous processing equipment, in order to perform shear deformation as one process step in a continuous process for processing the material by means of multiple process steps. For example, the material can be heated at a desired temperature, and then can be sheared. In this case, it is possible to connect the continuous shear deformation device to an apparatus for heating the material. In a case where a cast or rolled material is directly sheared, the continuous shear deformation device can be connected to a continuous casting apparatus or a rolling apparatus. In addition, the continuous shear deformation device can be connected to an apparatus for cooling, cutting, flattening, or winding the material extracted from the continuous shear deformation device.

With respect to this, the thickness of the material before passing through the rotary guide apparatus may be larger than the thickness of the material after passing through the same. For example, it can be assumed that the rotary guide apparatus is constructed by using a series of pairs of rotary rolls, the spacing between which being gradually reduced. In this case, it is possible to provide a compatible continuous shear deformation device to materials of different thickness, for example, thin-walled materials of a thickness less than 0.5 mm and thick-walled materials, irrespective of thickness of the materials, by rolling the materials corresponding to the clearance spacing of a material supply path having gradually reduced widths formed by the rotary guide apparatus, without any additional processing of the materials.

It is natural that the amount of shear deformation of the material is adjusted according to the angle of the curved portion. Moreover, it is also possible to additionally form one or more curved portions at the molding path of the mold besides the curved portion at the opening, so that the material is sheared more than two times while passing through the molding path.

Friction is most apparent in the vicinity of the curved portion in the mold at which shear deformation is occurred. Thus, in order to improve the abrasion resistance of the vicinity of the curved portion, it is possible to fabricate that portion using an ultralight material. At this time, the vicinity of the curved portion can be coated with the ultralight material, or it can be entirely made of the ultralight material.

In addition, some part including the curve portion in the mold, which is greatly abraded during shear deformation, can be constructed as a separate, replaceable component.

In order to reduce the power applied in the direction of the material by decreasing the friction between the mold and the material, it is preferable that a lubricant applicator is additionally included.

As another construction for reducing friction force, it is preferable that the widths of the molding path before the curved portion are formed to be larger than those of the molding path behind the curved portion, centering around the point spaced apart at a certain distance via the curved portion in the direction of the material, thereby reducing unnecessary friction between the material and the molding path.

Although the widths of the molding path before the curved portion are identical with those of the molding path behind the curved portion in general, it is also possible to design and fabricate a mold of which the widths of the molding path before and behind the curved portion are different from each other, so that the thickness of the material before shear deformation is different from that of the material after shear deformation.

BRIEF DESCRIPTION OF THE DRAWINGS

The present invention will become better understood with reference to the accompanying drawings which are given only by way of illustration and thus are not limitative of the present invention, wherein:

FIGS. 4*a* and 4*b* are photographs illustrating the change in scale on the lateral parts of a material when shear deformation is made using the conventional continuous shear deformation device, wherein FIG. 4*a* illustrates the change in scale prior to deformation, and FIG. 4*b* illustrates the change in scale after deformation;

FIGS. 6*a* and 6*b* are schematic views illustrating a continuous shear deformation device in accordance with one embodiment of the present invention, wherein FIG. 6*a* illustrates a continuous shear deformation device using a pair of rotary rolls as a rotary guide apparatus, and FIG. 6*b* illustrates a continuous shear deformation device using a single rotary roll as a rotary guide apparatus;

DETAILED DESCRIPTION OF THE PREFERRED EMBODIMENTS

The preferred embodiments of the present invention will now be described in detail with reference to the accompanying drawings.

Figure 5A:
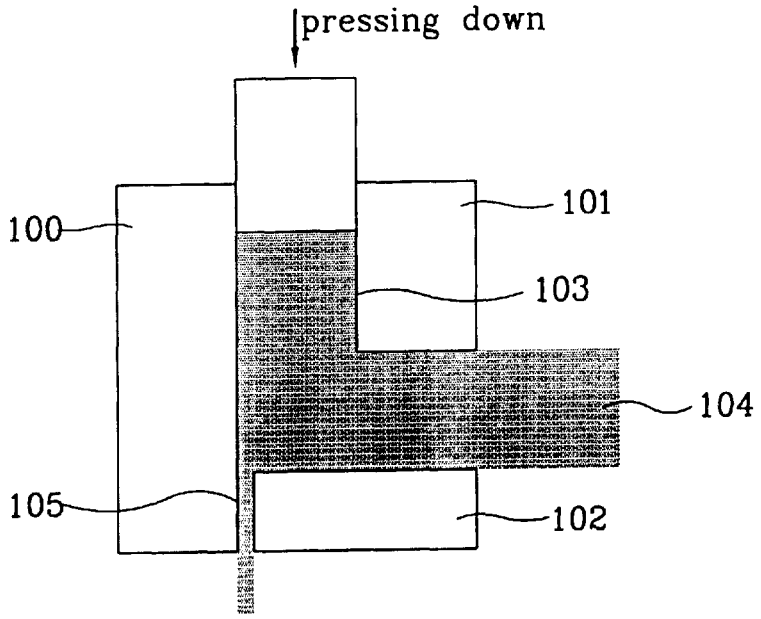
FIGS. 5*a* and 5*b* are schematic views illustrating a discontinuous equal channel angular pressing shear deformation device and an equal channel angular drawing shear deformation device.
Figure 5B:
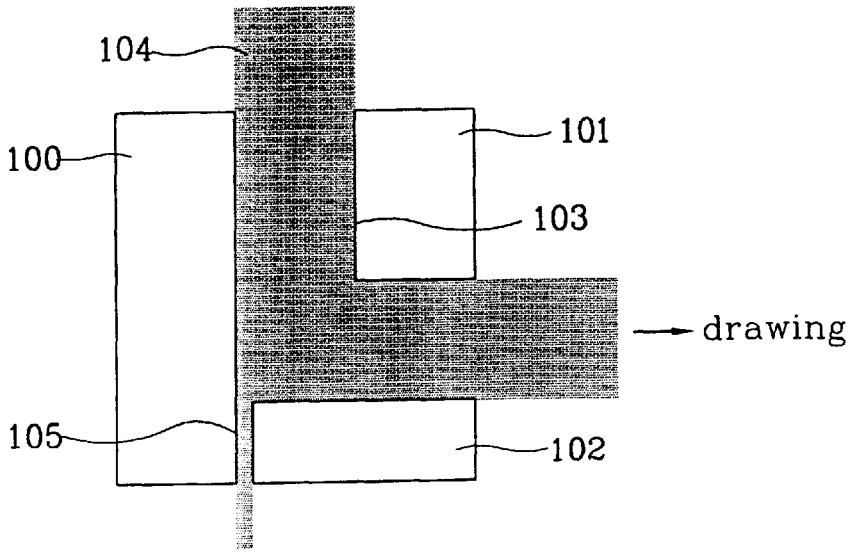
Figure 6A:
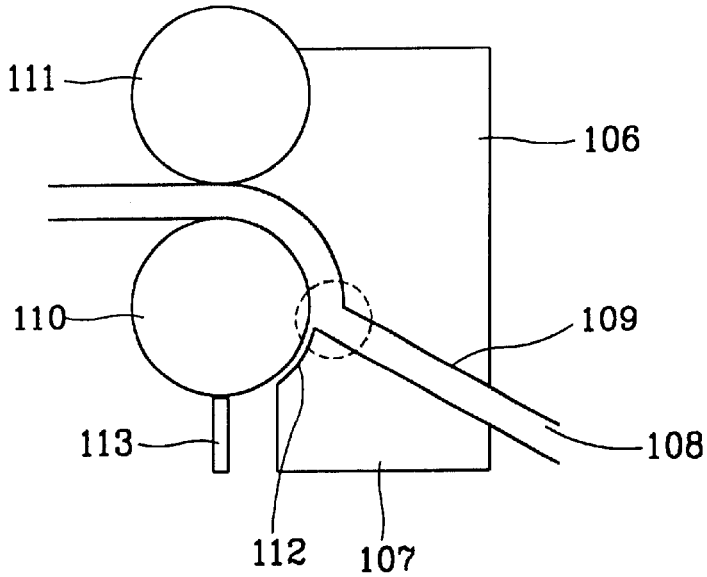
Figure 6B:
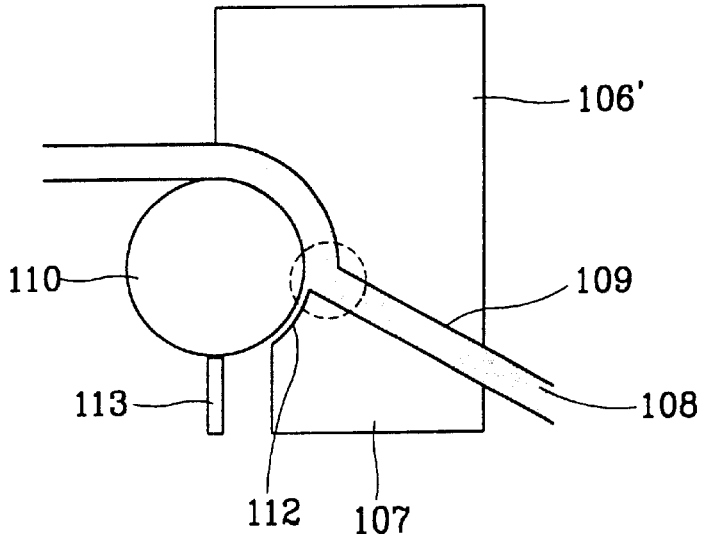

FIGS. 5*a* and 5*b* are schematic views illustrating the devices performing equal channel angular pressing and equal channel angular drawing in accordance with one embodiment of the present invention, and FIGS. 6*a* and 6*b* are schematic views illustrating continuous shear deformation devices each using two rotary rolls or a single rotary roll as a rotary guide apparatus in accordance with one embodiment of the present invention. As illustrated therein, the shear deformation device in accordance with the present invention includes molds 100, 101, 102, 106, 106', and 107 having molding paths 103 and 109 at which a curved portion is formed, a material guiding apparatus for guiding materials 104 and 108 to the molding paths 103 and 109. In the curved portion, scalping guide paths 105 and 112 allowing the surface of the material to be separated from the other portions of the material as the material is scalped at a predetermined thickness while passing through the curved portion during shear deformation, are formed in communication with the molding paths 103 and 109.

Figure 1A:
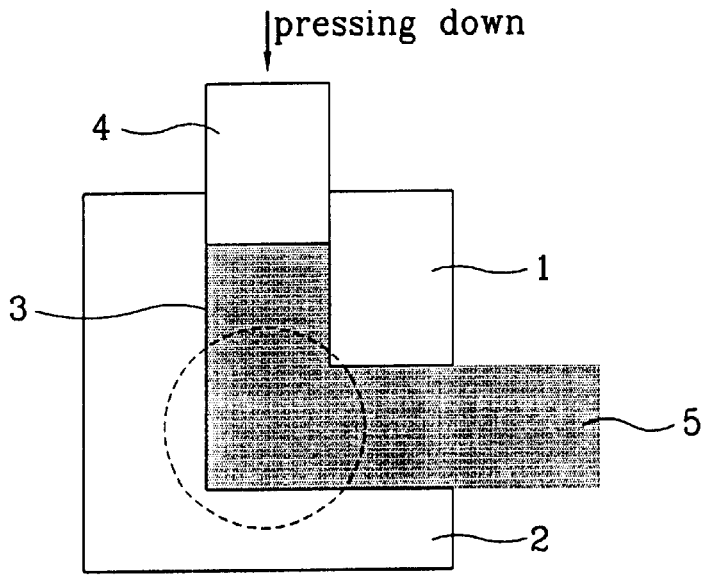
FIG. 1a PRIOR ART
FIG. 1*a* is a schematic view illustrating the device performing the conventional discontinuous equal channel angular pressing.
Figure 1B:
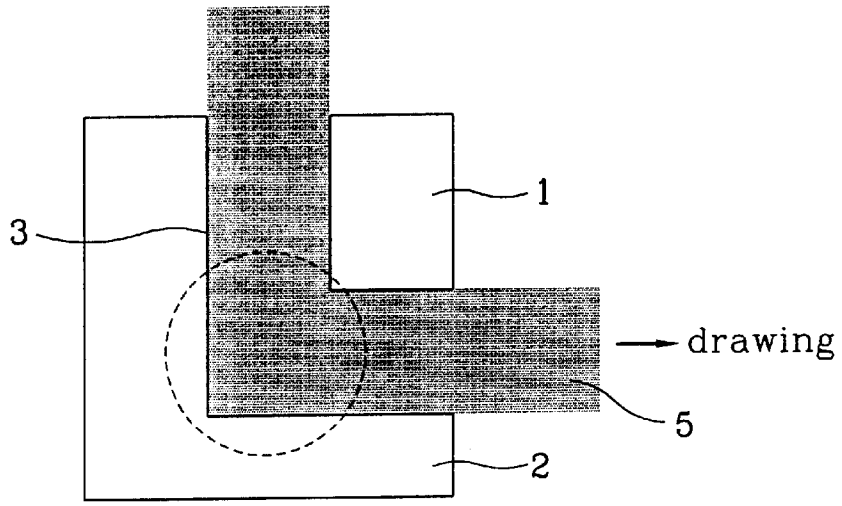
FIG. 1b PRIOR ART
FIG. 1*b* is a schematic view illustrating the device performing the conventional equal channel angular drawing is performed.
Figure 2:
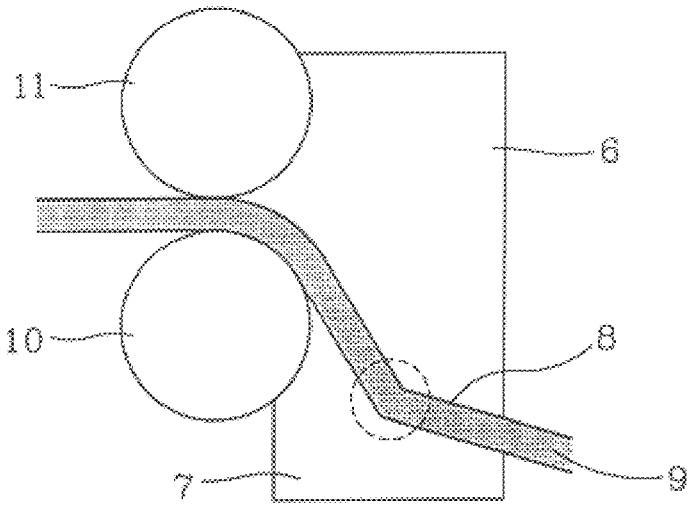
FIG. 2 PRIOR ART
FIG. 2 is a schematic view illustrating one example of a conventional discontinuous shear deformation device.
Figure 3:
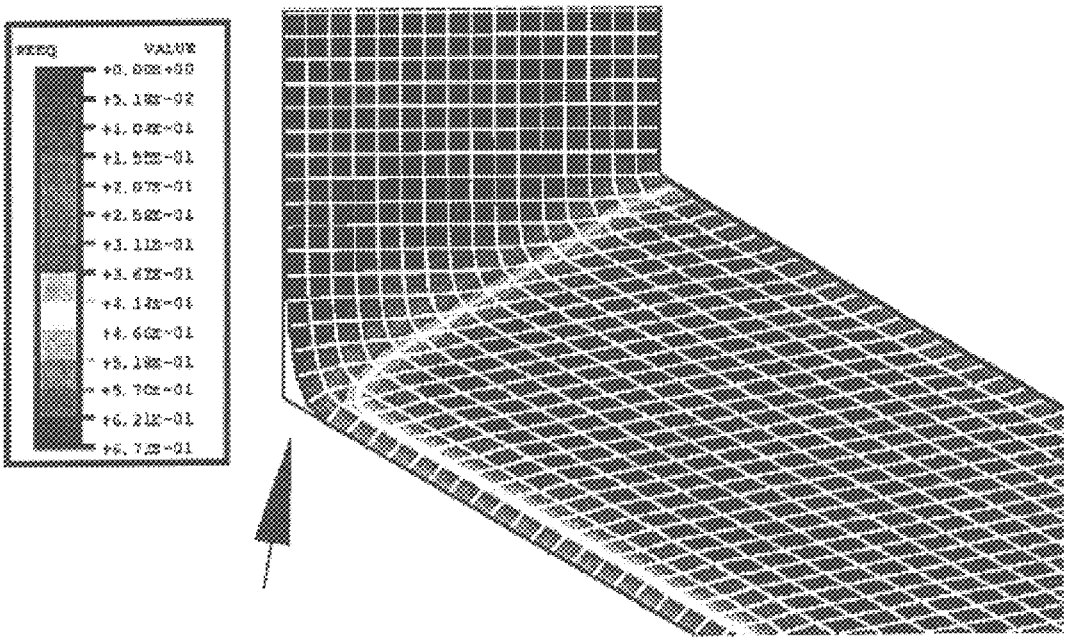
FIG. 3 is a view illustrating the deformation of a material occurred at a curved portion in a mold by means of simulation.

In case of using the continuous shear deformation device, of course, the curved portion can be formed in the middle of the molding path. In addition, it is preferable that the curved portion is constructed by collaboration between rotary guide apparatuses 110 and 111 and the opening of the molding path 109 so that shear deformation is occurred in the location at which the material is inserted from the rotary guide apparatuses 110 and 111 to the molding path 109, and the spacing between the rotary guide apparatuses 110 and 111 and the mold 107 constructs the scalping guide path 112. By constructing the curved portion by collaboration between the rotary guide apparatus 110 and the opening of the molding path 109 as illustrated in FIGS. 5*a* and 5*b*, rather than the middle of the molding path 8 as illustrated in FIG. 2, the following results can be obtained. Firstly, power is effectively transferred by increasing the contact area between the rotary guide apparatus 110 and the material 108. Secondly, the power of the rotary guide apparatus 110 to press down the material 108 is directly applied to the material 108 until the material 108 reaches the curved portion and is sheared, thereby reinforcing the contact between the lower part of the material and the curved portion, and accordingly making it possible to obtain an uniform and sufficient shear deformation of the lower and upper parts of the material.

Although the scalping guide paths 105 and 112 of the shear deformation device in accordance with the present invention may have a fixed inner spacing, it is preferable that the scalping guide paths 105 and 112 are constructed so that the inner spacing is adjusted by a spacing adjusting apparatus for adjusting the inner spacing of the scalping guide paths 105 and 112, in order to scalp the materials 104 and 108 at a desired thickness. As such a spacing adjusting apparatus, in case of the apparatus illustrated in FIGS. 5*a* and 5*b*, an apparatus capable of fixing the mold 100 at the front part or the mold 102 at the lower part in a state of being moved bilaterally in the drawings is employed, or, in case of the apparatus as illustrated in FIGS. 6*a* and 6*b*, an apparatus capable of fixing the same by bilaterally moving the rotary roll 110 is employed.

As the rotary guide apparatus, as illustrated in FIGS. 6*a* and 6*b*, the rotary rolls 110 and 111 contacting the material 108, or a belt transmission (not shown) for moving the material by rotating a belt contacting the material can be used. As the belt, belts of various shapes including a roof having a plurality of polyhedron blocks and a belt of which the inside is chain-shaped can be used. In addition, the rotary guide apparatus can be a combination of the rotary rolls and the belt transmission. For example, the rotary guide apparatus can be constructed by installing a plurality of rotary rolls at one side and a belt transmission at the other side. Also, in case of using the belt transmission, it is possible to use a combination of belts of various shapes.

Figure 7:
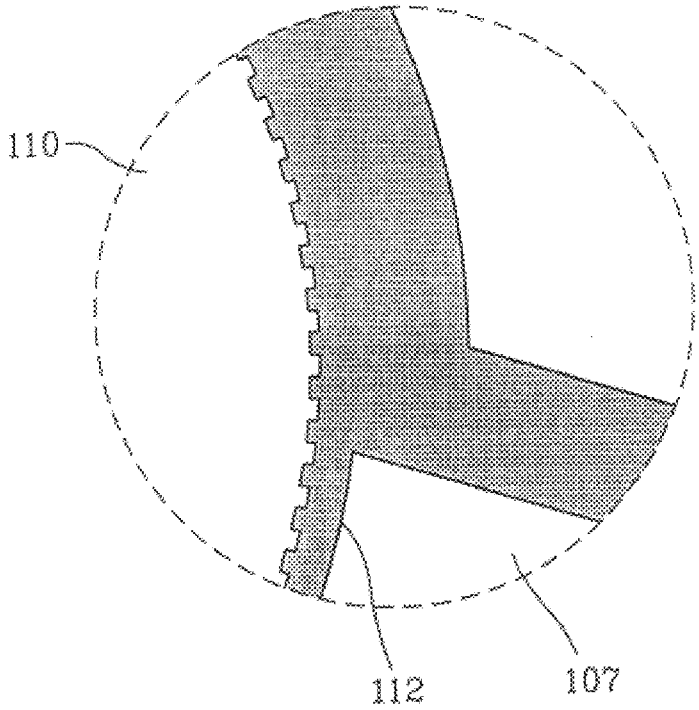
FIG. 7 is an expansion view illustrating the curved portion which is shown in dotted line of FIGS. 6*a* and 6*b;*

To reinforce the friction between the material and the rotary guide apparatus, as in FIG. 7 illustrating an expansion view of the curved portion shown in dotted line of FIGS. 6*a* and 6*b*, it is preferable that irregularity is formed on the surface contacting the material of the rotary guide apparatus, that is, the surfaces of the rotary rolls 110 and 111 or the surface of the belt. This irregularity is achieved by coating the surface with an additional material of high friction coefficient, or by increasing the surface roughness by forming irregularity by mechanical processing. In addition, it is also possible to fabricate a portion directly contacting the material throughout the entire rotary guide apparatus by using a material of high friction coefficient.

Figure 8:
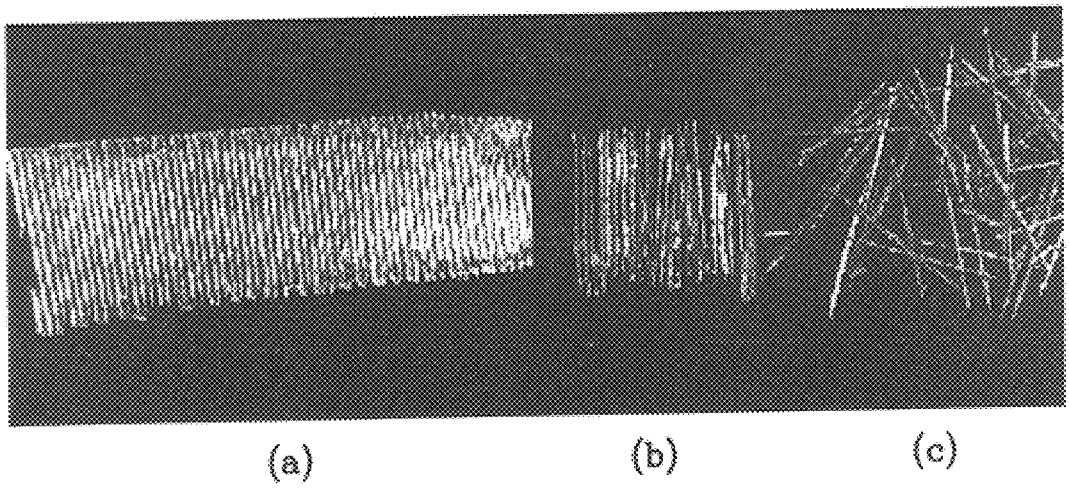
FIG. 8 is a photograph illustrating the shapes of chips removed from a material when the inner spacing of a scalping guide path is varied in a case where irregularity is formed on the surface contacting the material of a rotary guide apparatus in a continuous shear deformation device in accordance with one embodiment of the present invention.

FIG. 8 is a photograph illustrating the shapes of chips removed from a material when the inner spacing of a scalping guide path in a case where irregularity is formed on the surface contacting the material of a rotary guide apparatus in a continuous shear deformation device in accordance with one embodiment of the present invention. Herein, the inner spacing is 0.15 mm at the utmost left side, the inner spacing at the center is 0.05 mm, and the inner spacing at the utmost right side is almost 0 mm. In case of the inner spacing of almost 0 mm, it can be shown that the irregularity of the surface of the material is solely removed and the thickness of a scalped layer is increased as the inner spacing is increased.

Figure 9:
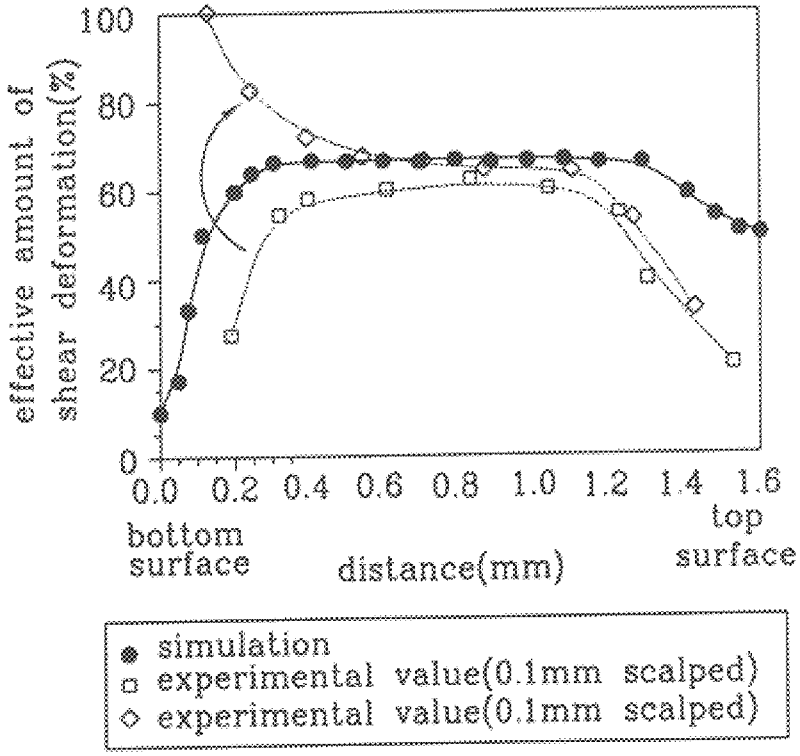
FIG. 9 is a graph illustrating the amount of shear deformation according to the location of the material in the thickness direction when shear deformation of the material is made by differentiating the thickness of a scalped layer.

Meanwhile, FIG. 9 is a graph illustrating the amount of shear deformation according to the location of the material in the thickness direction when shear deformation of the material is made by differentiating the thickness of a scalped layer. Herein, ● represents the result of simulation, □ represents the actual measured value in case of scalping the material at a thickness of 0.1 mm, and ♦ represents the actual measured value in case of scalping the material at a thickness of 0.2 mm. Herein, it can be known that the amount of shear deformation of the lower part of the material is increased as the thickness of the material that is scalped is increased.

Figure 4A:
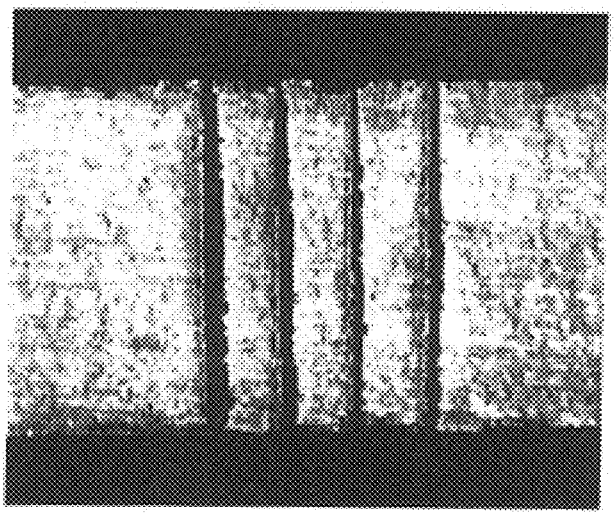
Figure 4B:
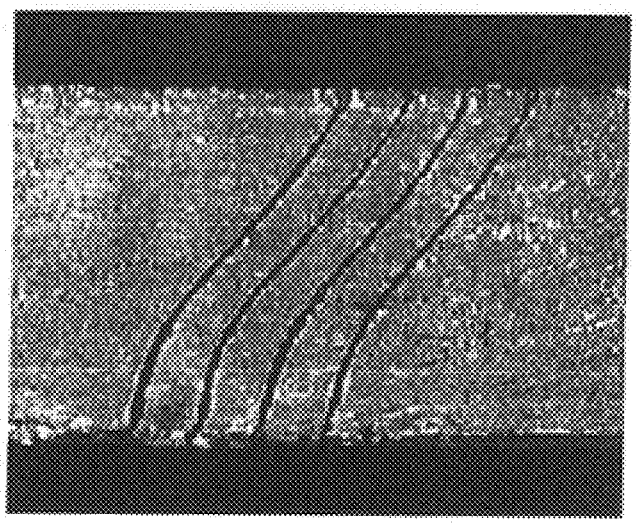
Figure 10:
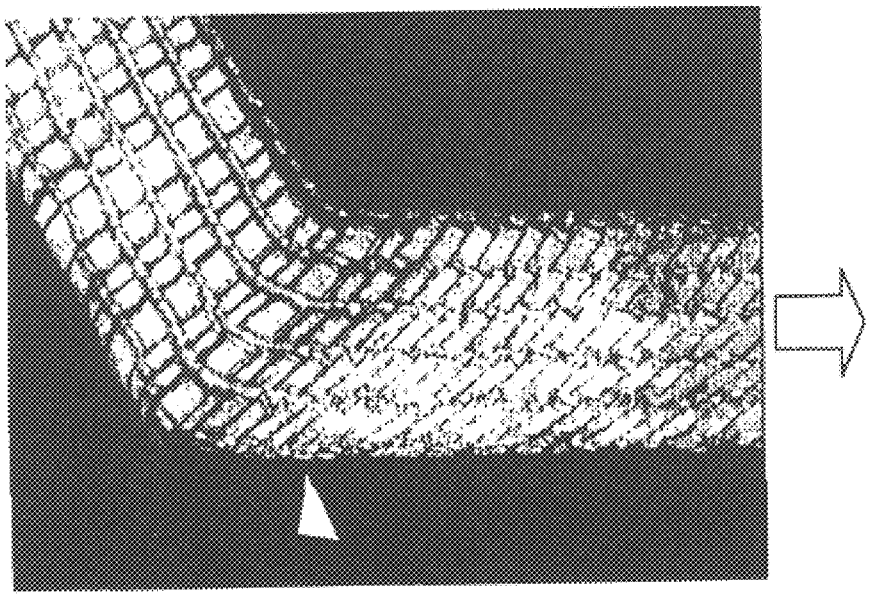
FIG. 10 is a photograph illustrating the change in scale on the lateral parts of a material by shear deformation in case of using a continuous shear deformation device in accordance with one embodiment of the present invention.

In addition, FIG. 10 is a photograph illustrating the change in scale on the lateral parts of a material by shear deformation in case of using a continuous shear deformation device when the inner spacing of the scalping guide path is set to 0.15 mm in accordance with one embodiment of the present invention. Unlike FIG. 4*b*, it can be known that sufficient shear deformation is also occurred at the lower part of the material.

As seen from the results of the experiment and the photographs, when the material is scalped during shear deformation by the device of the present invention, the irregularity and surface products formed on the surface of the material are removed for thereby facing the material. Besides, the layer to be scalped presses down the material while passing through the scalping guide path, being separated from the material, for thereby reinforcing the contact between the lower parts of the material and the curved portion, and appropriately performing shear deformation of the lower part of the material.

Meanwhile, although it is preferable that the scalped layer is guided and separated from the material through the scalping guide path between the rotary guide apparatus and the mold, it can be also attached to the surface contacting the material of the rotary guide apparatus by the power of the rotary guide apparatus to strongly press down the material. Thus, it is preferable that a scalped layer removing apparatus for removing the thusly attached scalped layer is additionally included. As such a scalping layer removing apparatus, a board plank 113 slightly contacting the portion not in contact with the material 108 of the rotary roll 110 of the rotary guide apparatus can be employed, as illustrated in FIGS. 6*a* and 6*b*.

And, it is preferable that a lateral guide for guiding and supporting the lateral parts of the material is installed at the rotary guide apparatus in order to prevent the material from being bilaterally moved while passing through the mold for the purpose of shear deformation. Such a lateral guide can be installed at one of the rotary guide apparatus and the mold, or at both of them, or at both of them as a plate girder contacting the lateral parts of the material.

In addition, although the above-described continuous shear deformation device can be used exclusively in no relation with other devices, it is preferable to construct the continuous shear deformation device by installing the rotary guide apparatus and the mold as one part of a continuous processing equipment, in order to perform shear deformation as one process step in a continuous process for processing the material by means of multiple process steps. For example, the material can be heated at a desired temperature, and then can be sheared. In this case, it is possible to connect the continuous shear deformation device to an apparatus for heating the material. In a case where a cast or rolled material is directly sheared, the continuous shear deformation device can be connected to a continuous casting apparatus or a rolling apparatus. In addition, the continuous shear deformation device can be connected to an apparatus for cooling, cutting, flattening, or winding the material extracted from the continuous shear deformation device.

Usually, the thickness of the material before and after passing through the rotary guide apparatus are identical with each other. However, in the present invention, the thickness of the material before passing through the rotary guide apparatus may be smaller than the thickness of the material after passing through the same. For example, it can be assumed that the rotary guide apparatus is constructed by using a series of pairs of rotary rolls, the spacing between which being gradually reduced. In this case, it is possible to provide a compatible continuous shear deformation device to materials of different thickness, for example, thin-walled materials of a thickness less than 0.5 mm and thick-walled materials, irrespective of thickness of the materials, by rolling the materials corresponding to the clearance spacing of a material supply path having gradually reduced top and bottom widths formed by the rotary guide apparatus, without using any additional rolling apparatus.

Figure 11A:
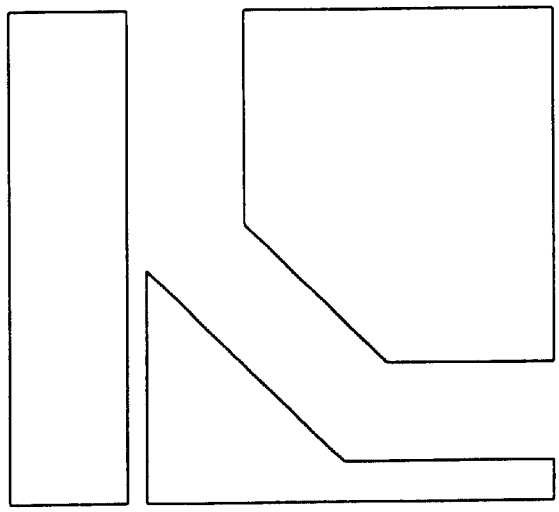
FIGS. 11*a* and 11*b* are schematic views illustrating a shear deformation device in accordance with another embodiment of the present invention, which includes a mold having two curved portions.
Figure 11B:
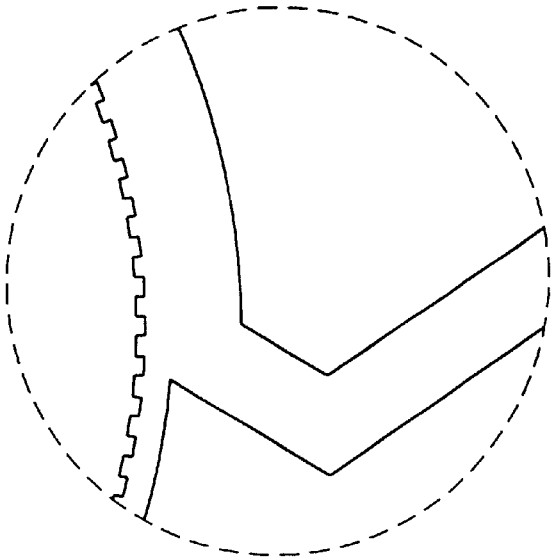

In the present invention, the amount of shear deformation of the material can be adjusted according to the angle of the curved portion. For instance, as the angle of the curved portion is increased, the amount of shear deformation is increased. In order to increase the amount of shear deformation, it is also possible to additionally form one or more curved portions at the molding path of the mold besides the curved portion at the opening, so that the material is sheared more than two times while passing through the molding path, as illustrated in FIGS. 11*a* and 11*b*.

In addition, to increase the amount of shear deformation of the material, the material having once passed through the continuous shear deformation device of the invention can be sheared while passing through the device at a desired number of times, or it is also possible that a desired number of continuous shear deformation devices are continuously installed, and then the material is sheared while passing through the devices.

Since friction is most apparent in the vicinity of the curved portion in the mold at which shear deformation of the material is occurred, the abrasion of the mold is most rapidly made. Thus, it is important to reduce the abrasion of that portion in order to increase the life span of the entire mold, so the vicinity of the curved portion is preferably made of ultralight material in order to improve the abrasion resistance of the vicinity the curved portion. At this time, the vicinity of the curved portion can be coated with the ultralight material, or it can be entirely made of the ultralight material.

In addition, one portion including the curve portion in the mold, which is greatly abraded during shear deformation, can be constructed as a separate, replaceable component, being separated from other portions of the mold.

In order to reduce the power applied in the direction of the material by decreasing the friction between the mold and the material, it is preferable that a lubricant applicator is additionally included.

The press-fit power, that is, the power of the rotary guide apparatus applied in the direction of the material corresponds to the power for shear deformation in the vicinity of the curved portion and the friction force between the mold and the material in the other portions. Thus, in order to perform shear deformation by a small press-fit power, it is important to decrease the friction force between the material and the mold excepting the curved portion. For this, it is preferable that a lubricant applicator is additionally included.

Figure 12A:
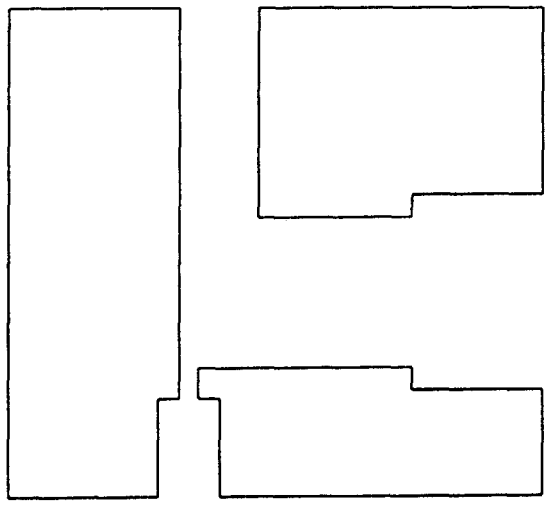
FIGS. 12*a* and 12*b* are schematic views illustrating a shear deformation device in accordance with still another embodiment of the present invention.
Figure 12B:
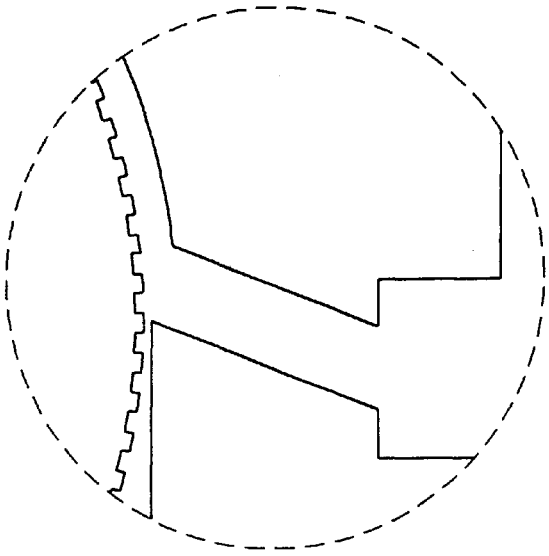

As another construction for reducing friction force, as illustrated in FIGS. 12*a* and 12*b*, it is preferable that the widths of the molding path before the curved portion are formed to be larger than those of the molding path behind the curved portion, centering around the point spaced apart at a certain distance via the curved portion in the direction of the material, thereby reducing unnecessary friction between the material and the molding path.

Generally, the widths of the molding path before the curved portion are identical with those of the molding path behind the curved portion in order to make the thickness of the material before the curved portion identical with the thickness of the material in rear of the curved portion. However, if necessary, as illustrated in FIGS. 12*a* and 12*b*, it is also possible to design and fabricate a mold of which the widths of the molding path before and behind the curved portion are different from each other, so that the thickness of the material before shear deformation is different from that of the material after shear deformation. Herein, the increase of the widths occurred when the material passes through the molding path is illustrated, and the decrease thereof is, of course, also possible.

Meanwhile, as illustrated in FIGS. 12*a* and 12*b*, it is preferable that the scalping guide path is formed to have an inner spacing at a distance from the opening of the scalping guide path larger than the inner spacing at the opening.

In case of using the above-described shear deformation device capable of scalping, the material is sheared, and at the same time the irregularity and surface products formed on the surface of the material are removed, so that it is possible to omit an additional surface processing for thereby improving the productivity.

In addition, the scalped layer separated from the material attracts the lower parts of the material to be tightly attached to the curved portion, so that the contact between the lower parts of the material and the curved portion is reinforced for thereby obtaining an uniform and sufficient amount of shear deformation throughout the material.

And, by reducing the friction between the material and the mold at the molding path excepting the curved portion at which shear deformation is occurred, it is possible to effectively press-fit the material by a small power and to increase the life span of the mold.

In addition, in case of using the rotary guide apparatus in accordance with the present invention, the apparatus can be compatibly used corresponding to materials of different thickness, that is, thin-walled materials and thick-walled materials without any additional process.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

What is claimed is:

1. A shear deformation device for scalping, comprising:

a mold having a mold path at which a curved portion is formed; and a material guiding apparatus for guiding a material to the molding path, wherein a scalping guide path which allows the surface of the material to be separated from the other portions of the material as the material is scalped at a predetermined thickness when passing through the curved portion during shear deformation is formed in the curved portion in communication with the molding path.

2. The device of claim 1, wherein the shear deformation device further comprises a spacing adjusting apparatus for adjusting the inner spacing of the scalping guide path, in order to scalp the material at a desired thickness.

3. The device of claim 1 or 2, wherein the guiding apparatus is a rotary guide apparatus, the curved portion is constructed by collaboration between the rotary guide apparatus and the opening of the molding path, and the separation between the rotary guide apparatus and the mold constructs the scalping guide path.

4. The device of claim 3, wherein the rotary guide apparatus comprises a rotary roll contacting materials.

5. The device of claim 3, wherein the rotary guide apparatus comprises a belt transmission for moving materials by rotating a belt contacting the materials.

6. The device of claim 5, wherein the belt is a roof having a plurality of polyhedron blocks sequentially connected to the same.

7. The device of claim 3, wherein irregularity is formed on the surface contacting the material of the rotary guide apparatus, in order to reinforce the friction between the material and the rotary guide apparatus.

8. The device of claim 3, wherein a lateral guide for guiding and supporting the material is provided at the rotary guide apparatus in order to prevent the material from being bilaterally moved.

9. The device of claim 3, wherein the shear deformation device further comprises a scalped layer removing apparatus for removing the scalped layer attached to the surface contacting the material of the rotary guide apparatus.

10. The device of claim 3, wherein the rotary guide apparatus and the mold are installed as one part of a continuous processing equipment, in order to perform shear deformation as one process step in a continuous process for processing the material by means of multiple process steps, the steps comprising at least one of (a) heating the material, (b) casting the material, (c) rolling the material, (d) cooling the material, (e) cutting the material, (f) flattening the material, and (g) winding the material.

11. The device of claim 3, wherein the rotary guide apparatus further comprises a rolling means for gradually reducing the thickness of the material guided to the mold and rolling the material into the mold.

12. The device of claim 1 or 2, wherein one or more curved portions are additionally formed at the molding path of the mold besides the curved portion at the opening, so that the material is sheared more than two times while passing through the molding path.

13. The device of claim 1 or 2, wherein the vicinity of the curved portion is made of ultralight material in order to improve the abrasion resistance of the vicinity of the curved portion in the mold.

14. The device of claim 1 or 2, wherein some part including the curve portion in the mold, which is greatly abraded during shear deformation, is constructed as a separate, replaceable component.

15. The device of claim 1 or 2, wherein the continuous shear deformation device further comprises a lubricant applicator in order to reduce the friction between the mold and the material.

16. The device of claim 1 or 2, wherein the widths of the molding path before the curved portion are formed to be larger than those of the molding path behind the curved portion, centering around the point spaced apart at a certain distance via the curved portion in the direction of the material.

17. The device of claim 1 or 2, wherein the scalping guide path is formed to have an inner spacing which is gradually increased so that the scalped material easily passes therethrough.

18. The device of claim 1 or 2, wherein the molding path in the mold is formed to have widths before and behind the curved portion different from each other.

* * * * *